US006891519B2

(12) United States Patent
Ooe et al.

(10) Patent No.: US 6,891,519 B2
(45) Date of Patent: May 10, 2005

(54) DISPLAY APPARATUS CAPABLE OF MAINTAINING HIGH IMAGE QUALITY WITHOUT DEPENDENCE ON DISPLAY LOAD, AND METHOD FOR DRIVING THE SAME

(75) Inventors: Takayuki Ooe, Kawasaki (JP); Toshio Ueda, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 190 days.

(21) Appl. No.: 10/288,484

(22) Filed: Nov. 6, 2002

(65) Prior Publication Data

US 2003/0179162 A1 Sep. 25, 2003

(30) Foreign Application Priority Data

Mar. 20, 2002 (JP) ..... 2002-078791

(51) Int. Cl.[7] ..... G09G 3/28
(52) U.S. Cl. ..... 345/63; 345/60; 345/68
(58) Field of Search ..... 345/60–72, 37, 345/41, 418, 530, 204

(56) References Cited

U.S. PATENT DOCUMENTS 5,877,764 A 3/1999 Feitelson et al.
2004/0095294 A1 * 5/2004 Yamada
2004/0164929 A1 * 8/2004 Ide et al.

FOREIGN PATENT DOCUMENTS

| | | |
|---|---|---|
| EP | 0 903 719 A3 | 3/1999 |
| EP | 0 903 719 A2 | 3/1999 |
| EP | 1 091 342 A2 | 4/2001 |
| JP | 6-332397 | 12/1994 |
| JP | 7-134565 | 5/1995 |
| JP | 2000-98970 | 4/2000 |
| JP | 2000-322025 | 11/2000 |
| TW | 473641 | 1/2002 |

* cited by examiner

*Primary Examiner*—Michael Razavi
*Assistant Examiner*—Tammy Pham
(74) *Attorney, Agent, or Firm*—Staas & Halsey LLP

(57) ABSTRACT

A driving method for a display apparatus produces light emission by applying a sustain discharge pulse repeatedly. A pulse width of the sustain discharge pulse is varied within one subfield and is controlled in accordance with the amount of voltage drop of a sustain discharge voltage. A display apparatus has a display panel section, a data converter, a power supply section, and a sustain discharge pulse control circuit. The data converter receives an image signal and supplies image data suitable for the display apparatus to the display panel section, and the power supply section supplies power to the display panel section. Further, the sustain discharge pulse control circuit varies a pulse width of sustain discharge pulse within one subfield and controls the pulse width of the sustain discharge pulse in accordance with the amount of voltage drop of a sustain discharge voltage.

24 Claims, 8 Drawing Sheets

DISPLAY APPARATUS CAPABLE OF MAINTAINING HIGH IMAGE QUALITY WITHOUT DEPENDENCE ON DISPLAY LOAD, AND METHOD FOR DRIVING THE SAME

BACKGROUND OF THE INVENTION

1. Field of the Invention

The present invention relates to a display apparatus and a method for driving the same, and more particularly to a display apparatus, such as a plasma display panel (PDP), that repeatedly carries out sustain discharges having sustain discharge pulses (light emission pulses) and adjusts the emission of light based on the number of repetitions, and a method for driving such a display apparatus.

2. Description of the Related Art

With the recent trend toward larger-screen displays, the need for thin display apparatuses has been increasing, and various types of thin display apparatus have been commercially implemented. Examples include matrix panels that display images by directly using digital signals, such as PDPs and other gas discharge display panels, digital micromirror devices (DMDs), EL display devices, fluorescent display tubes, and liquid crystal display devices. Among such thin display devices, gas discharge display panels are considered to be the most promising candidate for large-area, direct-view HDTV (high-definition television) display devices, because of the simple production process which facilitates fabrication of larger-area displays, a self-luminescent property which ensures good display quality, and a high response speed.

For example, in the PDP, one field is divided into a plurality of light emission blocks (subfields: SFs) each comprising a plurality of sustain discharge pulses, and a grayscale is displayed by combining these subfields. That is, the PDP achieves a grayscale display by repeating sustain discharges with sustain discharge pulses and thereby adjusting the light emission time.

During the sustain discharge period, the current (sustain discharge current) is initially small, but gradually increases toward the end of the sustain discharge period as the sustain discharge is repeated. Since power is consumed by the sustain discharge, the sustain discharge voltage decreases in a manner that is inversely proportional to the current, and this decrease of the sustain discharge voltage results in an incomplete sustain discharge; accordingly, there is a need for a display apparatus that can perform control considering the sustain voltage drop when displaying an image that consumes much power, and also a need for a method for driving such a display apparatus.

In this specification, the term "field" is used by assuming the case of interlaced scanning in which one image frame is made up of two fields, an odd field and an even field, but in the case of progressive scanning in which one image frame is made up of one field, the term "field" can be used interchangeably with "frame".

In the prior art, sustain discharge pulses are set, for example, by calculating a display load ratio for each frame from display data and by performing computation based on the display load ratio for each frame (field) so that the power consumption of the display apparatus will not exceed a predetermined value. Such techniques are disclosed, for example, in Japanese Unexamined Patent Publication (Kokai) Nos. 06-332397 and 2000-098970.

More specifically, Japanese Unexamined Patent Publication (Kokai) No. 06-332397 discloses a flat panel display apparatus comprising an integrating means for integrating the number of pixel signals of a prescribed level applied during a prescribed period, and a frequency changing means for changing the panel driving frequency based on the result of the integration of the integrating means, while Japanese Unexamined Patent Publication (Kokai) No. 2000-098970 discloses a plasma display apparatus comprising an integrating means for integrating, for each bit signal used to achieve grayscale display, the number of pixel signals applied during a prescribed period, and a frequency changing means for changing the frequency of a sustain discharge waveform, based on the result of the integration of the integrating means.

The prior art and its associated problems will be described in detail later with reference to accompanying drawings.

SUMMARY OF THE INVENTION

An object of the present invention is to provide a display apparatus capable of maintaining high image quality without depending on display load, and a method for driving such a display apparatus.

According to the present invention, there is provided a driving method for a display apparatus that produces light emission by applying a sustain discharge pulse repeatedly, wherein a pulse width of the sustain discharge pulse is varied within one subfield and is controlled in accordance with the amount of voltage drop of a sustain discharge voltage.

The sustain discharge voltage may be actually detected, and the pulse width of the sustain discharge pulse may be controlled in accordance with the detected sustain discharge voltage. A load ratio of a plurality of subfields forming one filed may be detected, and the pulse width of the sustain discharge pulse may be controlled in accordance with the detected subfield load ratio. A weighted average load ratio of one entire field may be calculated, and the pulse width of the sustain discharge pulse may be controlled in accordance with the calculated weighted average load ratio.

Further, according to the present invention, there is provided a driving method for a display apparatus that produces light emission by applying a sustain discharge pulse repeatedly, wherein a pulse width of the sustain discharge pulse is varied within one subfield, and control is performed by making the pulse width of the sustain discharge pulse narrow in a first half of a sustain discharge period and wide in a second half thereof.

Further, according to the present invention, there is also provided a driving method for a display apparatus that produces light emission by applying a sustain discharge pulse repeatedly, wherein a pulse width of the sustain discharge pulse is varied within one subfield, and control is performed so that the pulse width of the sustain discharge pulse is narrow in an early part of a sustain discharge period, but gradually increases toward the end of the sustain discharge period.

In addition, according to the present invention, there is provided a driving method for a driving method for a display apparatus that produces light emission by applying a sustain discharge pulse repeatedly, wherein a pulse width of the sustain discharge pulse is varied within one subfield, and control is performed so that the pulse width of the sustain discharge pulse is narrow in a specific part within the subfield, but gradually increases after the specific part within the subfield.

The pulse width of the sustain discharge pulse may be controlled so that at least a first pulse in the sustain discharge period has a wide pulse width. The total number of sustain discharge pulses in one entire field may be calculated, and the pulse width of the sustain discharge pulse may be controlled in accordance with the calculated total number of sustain discharge pulses. When the calculated total number of sustain discharge pulses is smaller than the number of sustain discharge pulses whose pulse width is made wider identically in all subfields, and when the number of sustain discharge pulses in each of the subfields is smaller than the number of pulses having an off time that makes the pulse width of every sustain discharge pulse wider, the pulse width of every one of the sustain discharge pulses in the all subfields may be made wider. The one field may be made up of a plurality of subfields, and a grayscale may be displayed by combining the subfields. The display apparatus may be a plasma display apparatus.

According to the present invention, there is provided a display apparatus comprising a display panel section; a data converter which receives an image signal and supplies image data suitable for the display apparatus to the display panel section; a power supply section which supplies power to the display panel section; and a sustain discharge pulse control circuit which varies a pulse width of sustain discharge pulse within one subfield and controls the pulse width of the sustain discharge pulse in accordance with the amount of voltage drop of a sustain discharge voltage.

The power supply section may actually detect the sustain discharge voltage, and the sustain discharge pulse control circuit may control the pulse width of the sustain discharge pulse in accordance with the detected sustain discharge voltage. The data converter may detect a load ratio of each of the subfields forming one field, and the sustain discharge pulse control circuit may control the pulse width of the sustain discharge pulse in accordance with the detected load ratio of the each subfield. The data converter may calculate a weighted average load ratio of one entire field, and the sustain discharge pulse control circuit may control the pulse width of the sustain discharge pulse in accordance with the calculated weighted average load ratio.

Further, according to the present invention, there is provided a display apparatus comprising a display panel section; a data converter which receives an image signal and supplies image data suitable for the display apparatus to the display panel section; a power supply section which supplies power to the display panel section; and a sustain discharge pulse control circuit which varies a pulse width of sustain discharge pulse within one subfield and performs control by making the pulse width of the sustain discharge pulse narrow in a first half of a sustain discharge period and wide in a second half thereof.

Further, according to the present invention, there is also provided a display apparatus comprising a display panel section; a data converter which receives an image signal and supplies image data suitable for the display apparatus to the display panel section; a power supply section which supplies power to the display panel section; and a sustain discharge pulse control circuit which varies a pulse width of sustain discharge pulse within one subfield and performs control so that the pulse width of the sustain discharge pulse is narrow in an early part of a sustain discharge period, but gradually increases toward the end of the sustain discharge period.

In addition, according to the present invention, there is provided a display apparatus comprising a display panel section; a data converter which receives an image signal and supplies image data suitable for the display apparatus to the display panel section; a power supply section which supplies power to the display panel section; and a sustain discharge pulse control circuit which varies a pulse width of sustain discharge pulse within one subfield and performs control so that the pulse width of the sustain discharge pulse is narrow in a specific part within the subfield, but gradually increases after the specific part within the subfield.

The sustain discharge pulse control circuit may control the pulse width of the sustain discharge pulse so that at least a first pulse in the sustain discharge period has a wide pulse width. The display apparatus may further comprise a power control circuit which adjusts the number of sustain discharge pulses by receiving a display load ratio from the data converter and information from the power supply section about power being consumed in the display panel section, and wherein the power control circuit may calculate the number of sustain discharge pulses in one entire field, and the sustain discharge pulse control circuit may control the pulse width of the sustain discharge pulse in accordance with the calculated number of sustain discharge pulses.

The calculated total number of sustain discharge pulses may be smaller than the number of sustain discharge pulses whose pulse width is made identically wider in all subfields, and when the number of sustain discharge pulses in each of the subfields is smaller than the number of pulses having an off time that makes the pulse width of every sustain discharge pulse wider, the sustain discharge pulse control circuit may make the pulse width of every one of the sustain discharge pulses in the all subfields wider. The one field may be made up of a plurality of subfields, and the display apparatus may display a grayscale by combining the subfields. The display apparatus may be a plasma display apparatus.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

Before proceeding to the detailed description of the preferred embodiments of a display apparatus and its driving method according to the present invention, a display apparatus and its driving method according to the prior art and their problems will be described with reference to drawings.

Figure 1:
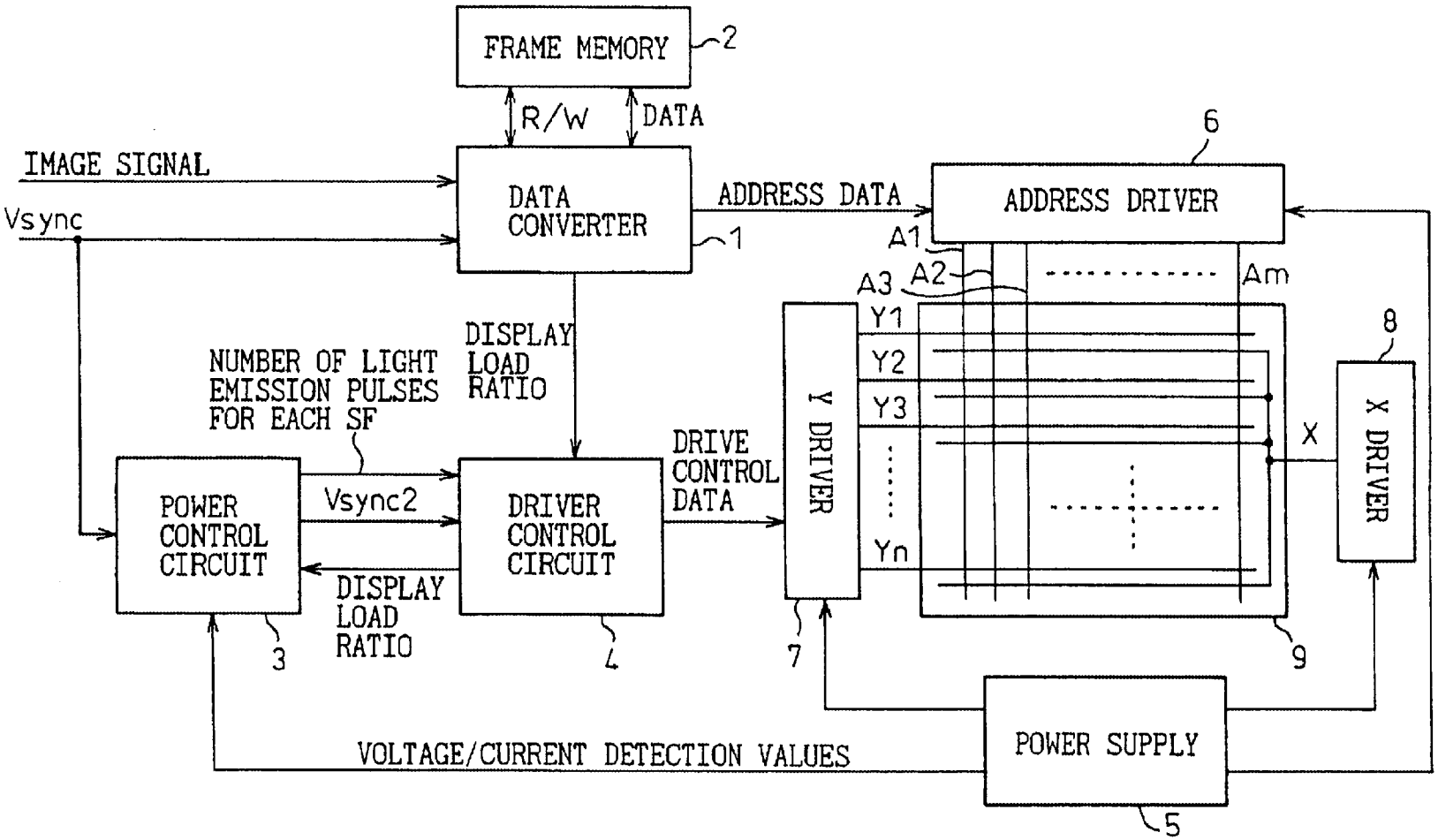
FIG. 1 is a block diagram showing one example of a display apparatus to which the present invention is applied.

FIG. 1 is a block diagram showing one example of a display apparatus to which the present invention is applied; here, one example of a plasma display apparatus (plasma display panel: PDP) is illustrated. In FIG. 1, reference numeral 1 is a data converter, 2 is a frame memory, 3 is a power control circuit, 4 is a driver control circuit, 5 is a power supply, 6 is an address driver, 7 is a Y driver, 8 is an X driver, and 9 is a display panel.

As shown in FIG. 1, the data converter 1 receives an image signal and a vertical synchronization signal Vsync from the outside, and converts them into PDP display data (data for displaying an image using a plurality of subfields SFs). The frame memory 2 holds the PDP display data converted by the data converter 1 and to be used in the next field. The data converter 1 then reads the data previously held in the frame memory 2 and supplies it as address data to the address driver 6, while at the same time, providing its display load ratio to the driver control circuit 4. Here, the display load ratio is found by counting the number of cells to be excited (dots to be illuminated) in each subfield.

The driver control circuit 4 receives from the power control circuit 3 a control signal for controlling the number of sustain discharge pulses (sustain pulses) for each subfield (SF) and an internally generated vertical synchronization signal Vsync2, and supplies drive control data to the Y driver 7. The data signal of the display load ratio, output from the data converter 1, is supplied to the power control circuit 3 via the driver control circuit 4.

The display panel 9 includes address electrodes A1 to Am, Y electrodes Y1 to Yn, and X electrodes X, which are driven by the address driver 6, the Y driver 7, and the X driver 8, respectively. The power supply 5, while supplying power to the address driver 6, Y driver 7, and X driver 8, detects voltages and currents from the address driver 6, Y driver 7, and X driver 8 and supplies the detected values to the power control circuit 3. That is, the address voltage and current from the address driver 6 and the sustain discharge voltage and sustain discharge current from the Y driver 7 and X driver 8 are detected, and the detected values are supplied from the power supply 5 to the power control circuit 3 for processing therein. The address driver 6, the Y driver 7, the X driver 8, and the display panel 9 together constitute the display panel section.

Figure 2:
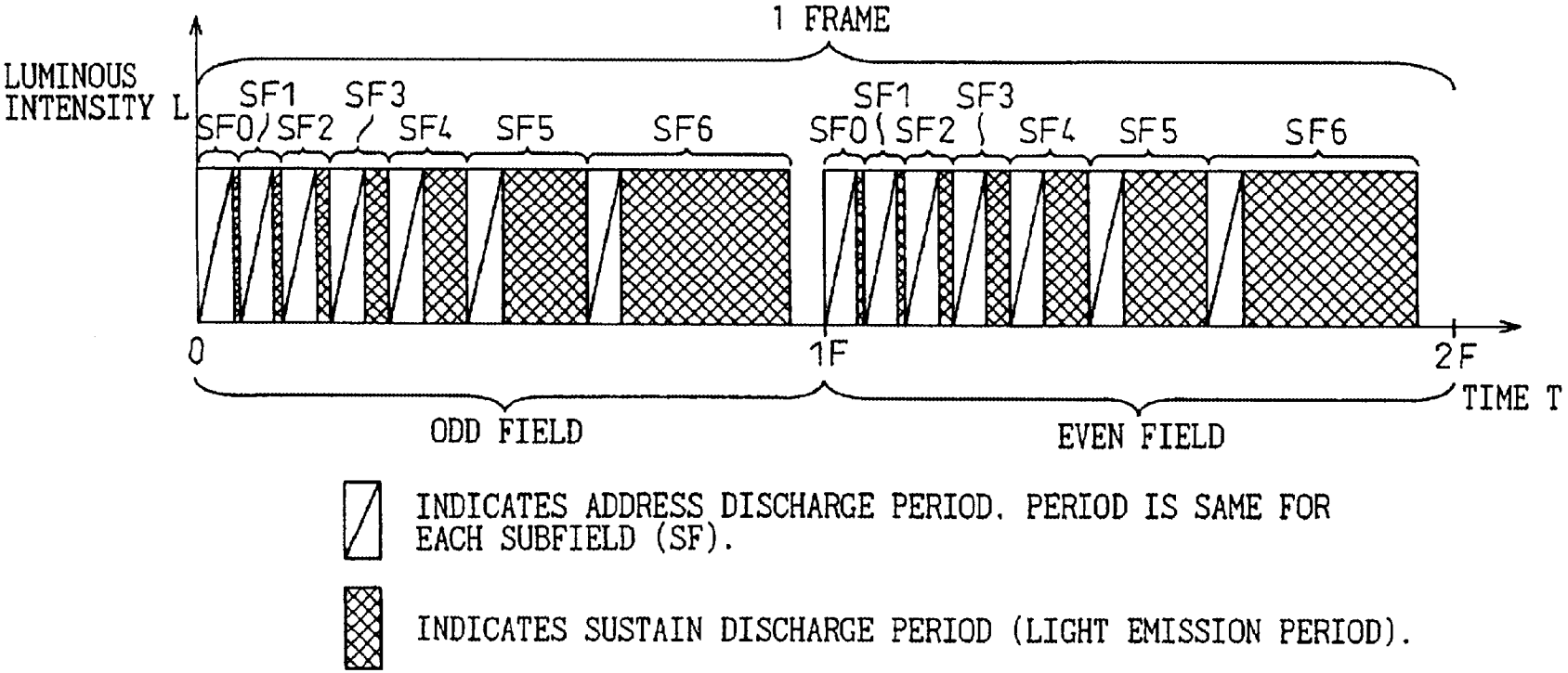
FIG. 2 is a diagram for explaining one example of a driving method for the display apparatus shown in FIG. 1.

FIG. 2 is a diagram for explaining one example of a driving method for the display apparatus shown in FIG. 1.

The driving method shown in FIG. 2 displays one image frame by interlacing two fields, an odd field and an even field, and the odd field and the even field are each made up of a plurality of subfields (for example, seven subfields SF0 to SF6). Each of the subfields SF0 to SF6 has an address discharge period, during which address discharge is performed to excite cells in accordance with the address data, and a sustain discharge period (light emission period), during which sustain discharge pulses (light emission pulses) are applied to the selected cells (illuminated cells) to sustain the light emission state. Here, the weights of the subfields SF0 to SF6 are given by SF0:SF1:SF2:SF3:SF4:SF5:SF6=1:2:4:8:16:32:64.

Figure 3:
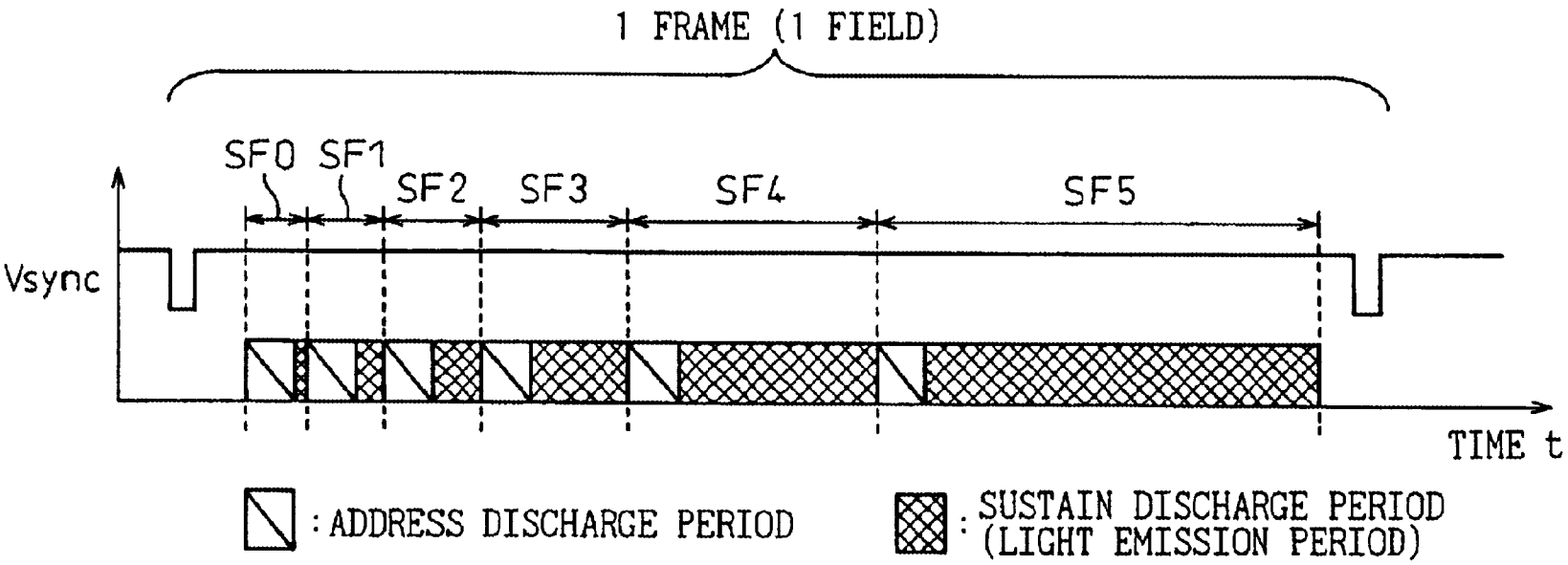
FIG. 3 is a diagram for explaining another example of the driving method for the display apparatus shown in FIG. 1.

FIG. 3 is a diagram for explaining another example of the driving method for the display apparatus shown in FIG. 1.

The driving method shown in FIG. 3 displays one image frame by progressive scanning in a single field, and the field (frame) is made up of a plurality of subfields (for example, six subfields SF0 to SF5). Each of the subfields SF0 to SF5 has an address discharge period, during which address discharge is performed to excite cells in accordance with the address data, and a sustain discharge period, during which sustain discharge pulses are applied to the selected cells to sustain the light emission state. Here, the weights of the subfields SF0 to SF5 are given by SF0:SF1:SF2:SF3:SF4:SF5=1:2:4:8:16:32.

It will be appreciated that the number of subfields, weight ratios, etc. in FIGS. 2 and 3 can be changed in various ways.

Figure 4:
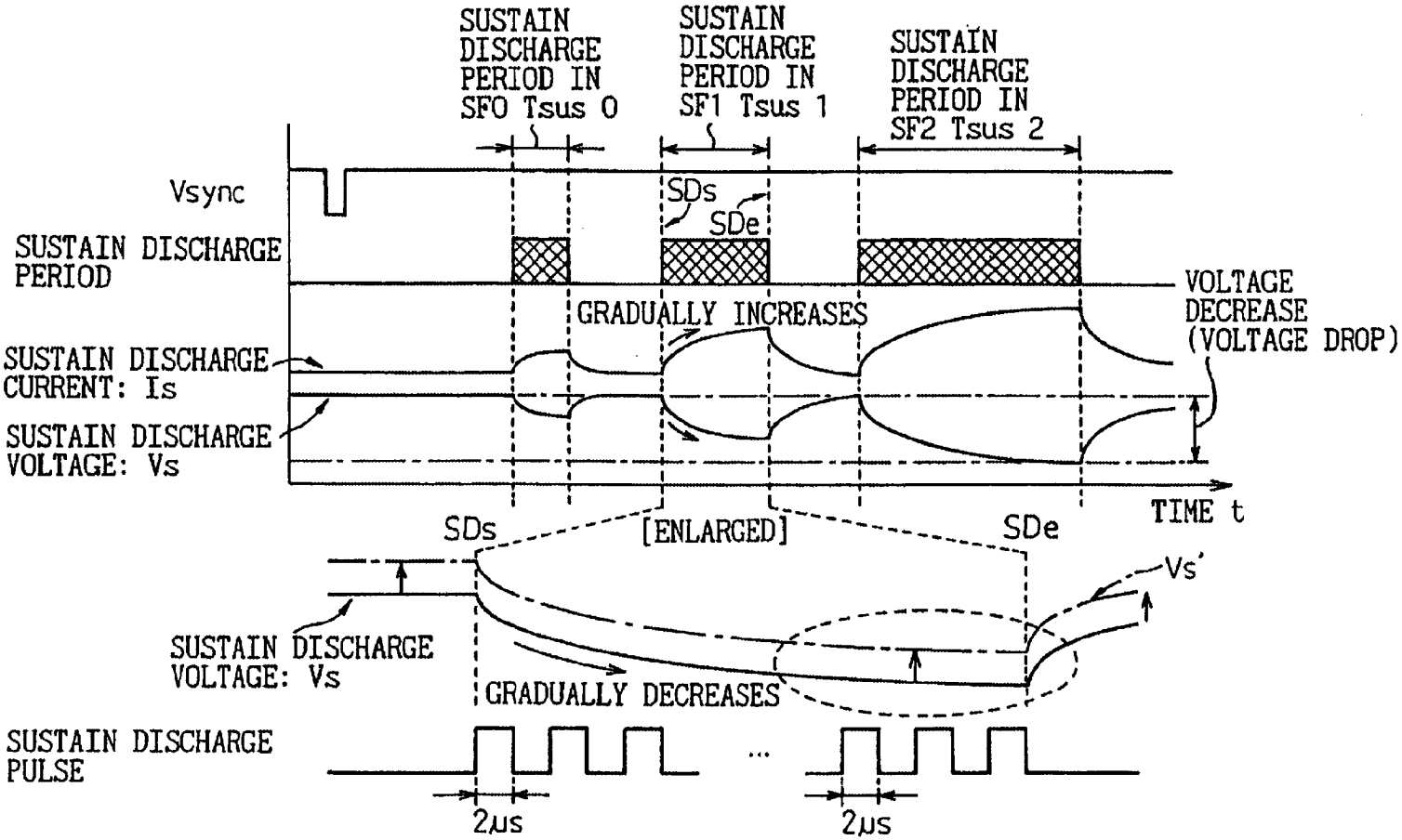
Fig.4 (PRIOR ART)
FIG. 4 is a diagram for explaining one example of a prior art display apparatus driving method.

FIG. 4 is a diagram for explaining one example of a prior art display apparatus driving method, showing the relationships between the sustain discharge voltage Vs, sustain discharge current Is, and sustain discharge pulse period Tsus (Tsus0, Tsus1, Tsus2).

As shown in FIG. 4, in the sustain discharge period Tsus (Tsus1) in each subfield SF (for example, subfield SF1), the sustain discharge current Is begins to gradually increase from the start position SDs of the period and, inversely proportional to it, the sustain discharge voltage Vs gradually decreases. The sustain discharge current Is reaches a maximum value at the end position SDe of the sustain discharge period Tsus (Tsus1), while the sustain discharge voltage Vs reaches a minimum value at the end position SDe of the sustain discharge period Tsus (Tsus1). Here, the sustain discharge pulse width is constant (for example, 2 $\mu$s) throughout the sustain discharge period Tsus (Tsus1).

To achieve high brightness, the number of sustain discharge pulses must be increased, but if the number of sustain discharge pulses is increased, the sustain discharge voltage Vs further drops.

On the other hand, when displaying any kind of image, if complete sustain discharge is to be achieved, the sustain discharge voltage Vs having the voltage drop shown by the solid line in FIG. 4 must be raised to the sustain discharge voltage Vs' shown by the semi-dashed line in FIG. 4 by considering the amount of the voltage drop.

However, if the sustain discharge voltage Vs is raised, there arise various problems in terms of the breakdown voltage of driver circuitry, heat dissipation, power consumption, etc., and in reality, the sustain discharge voltage Vs cannot be set high enough. Accordingly, in the prior art display apparatus, the voltage drop of the sustain discharge voltage Vs has resulted in insufficient sustain discharge, and hence degradation in display quality.

Embodiments of the display apparatus and its driving method according to the present invention will be described in detail below with reference to drawings. Here, it will be recognized that the display apparatus and its driving method according to the present invention are not limited in application to interlaced scan PDPs, but can be applied widely to various other display apparatuses, including progressive scan PDPs.

Figure 5:
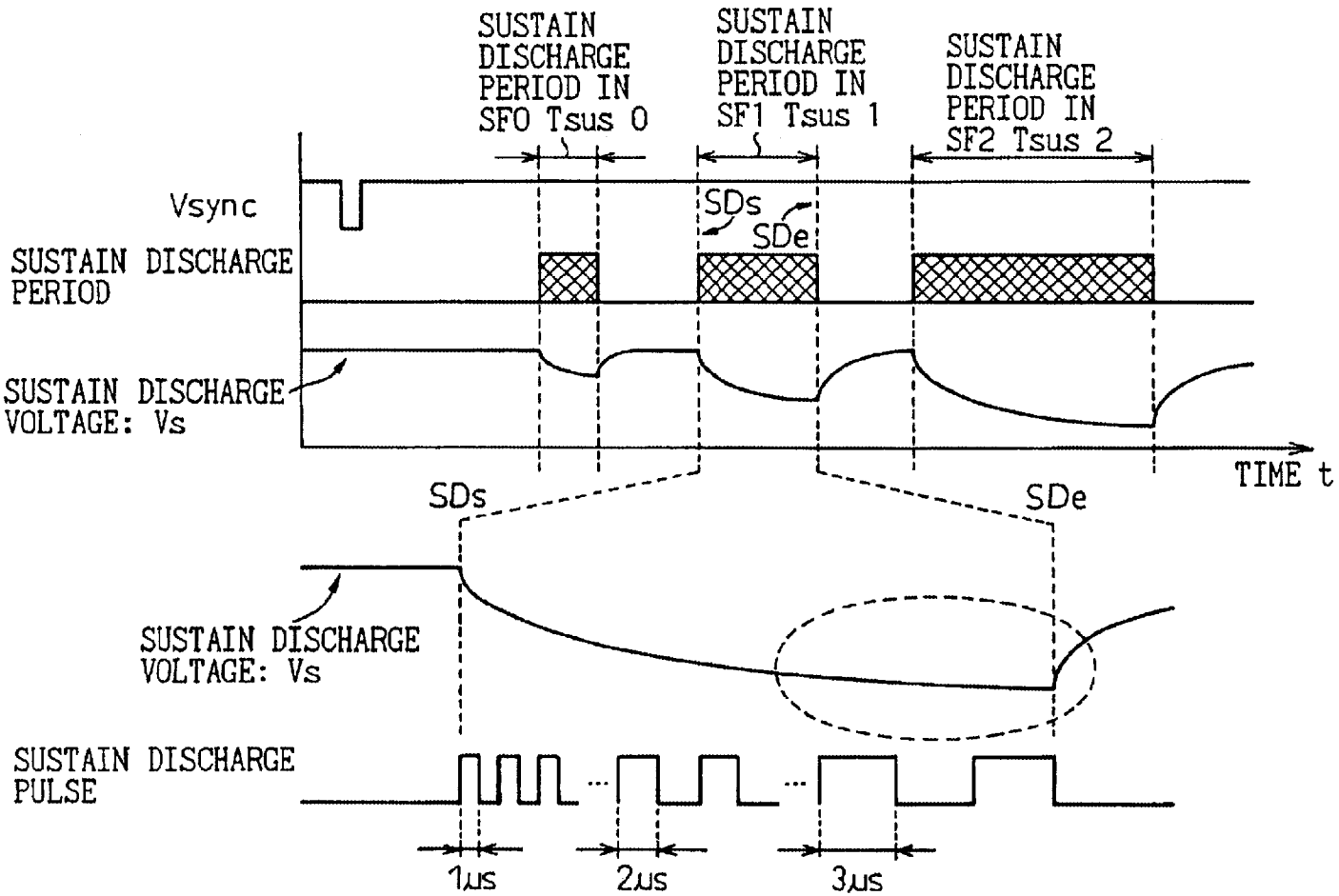
FIG. 5 is a diagram for explaining one embodiment of a display apparatus driving method according to the present invention.

FIG. 5 is a diagram for explaining one embodiment of the display apparatus driving method according to the present invention.

As is apparent from a comparison between FIG. 5 and the above-described FIG. 4, in the display apparatus driving method according to this embodiment, the sustain discharge pulse with is varied within one subfield (for example, SF1), rather than raising the sustain discharge voltage Vs by considering the amount of its voltage drop.

As shown in FIG. 5, the amount of drop (voltage drop) of the sustain discharge voltage Vs within one subfield SF1 differs at different positions in the sustain discharge period Tsus1. More specifically, the voltage level of the sustain discharge voltage Vs begins to gradually decrease from the start position SDs of the sustain discharge period Tsus1, and reaches a minimum value at the end position SDe of the sustain discharge period Tsus1.

In view of this, in this embodiment, the pulse width (the width of the sustain discharge voltage level of the sustain discharge pulse) is set narrow (for example, 1 μs) at positions near the start position SDs of the sustain discharge period Tsus1, and the pulse width is increased (for example, to 2 μm) at positions in the middle, and is further increased (for example, to 3 μm) at positions near the end position SDe of the sustain discharge period Tsus1, compensating for the voltage drop of the sustain discharge voltage Vs by thus increasing the sustain discharge pulse width. Needless to say, the pulse widths among which the sustain discharge pulse width is varied within one subfield are not limited to the above three pulse widths (1 μs, 2 μs, and 3 μs).

That is, the sustain discharge pulse width within one subfield can be controlled in such a manner that it is narrow in the first half of the sustain discharge period Tsus but wide in the second half of the sustain discharge period, or in such a manner that it is initially narrow but gradually becomes wide toward the end of the sustain discharge period Tsus.

Thus, to address the situation where the voltage level of the sustain discharge voltage drops toward the end of the sustain discharge period, resulting in insufficient sustain discharge and hence an inability to form a sufficient wall charge, the display apparatus driving method of this embodiment increases the sustain discharge pulse width, thereby allowing a sufficient wall charge to be formed even with a low sustain discharge voltage and thus achieving complete sustain discharge.

Here, if the display load ratio of the entire field (frame) becomes large, the number of sustain discharge pulses is reduced to reduce the power consumption. In this case, the resulting off period is diverted to the sustain discharge period so that sustain discharge pulses of wider pulse width can be applied at positions where the sustain discharge current is large; in this way, a high display quality can be maintained even when the display load varies.

Thus, according to the display apparatus driving method of this embodiment, it becomes possible to maintain a high display quality by compensating for incomplete sustain discharge resulting from the voltage drop of the sustain discharge voltage, without having to raise the voltage level of the sustain discharge voltage.

Figure 6:
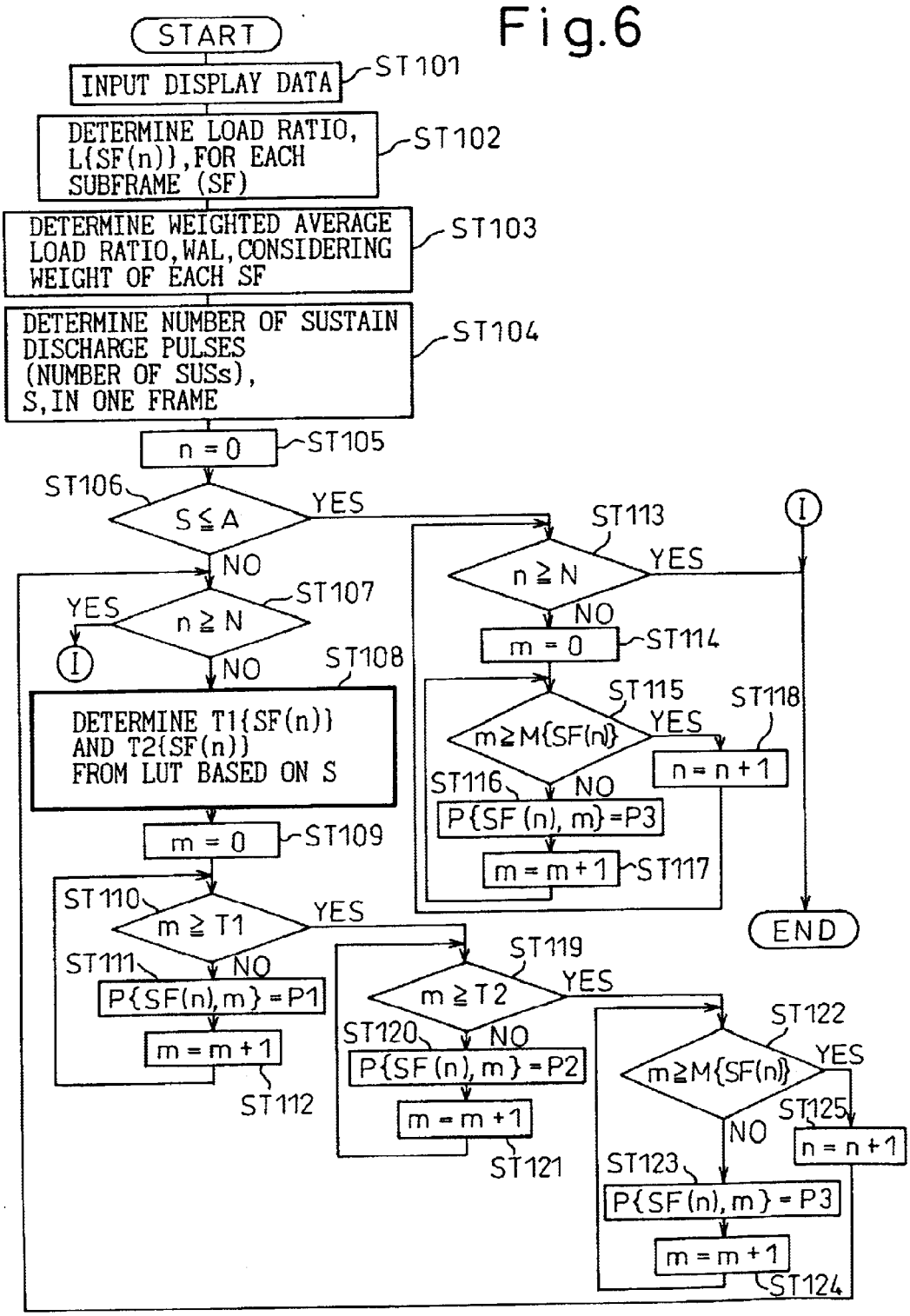
FIG. 6 is a flowchart showing one example of the display apparatus driving method according to the present invention.

FIG. 6 is a flowchart showing one example of the display apparatus driving method according to the present invention, in which the sustain discharge pulse width is controlled in accordance with the total number of sustain discharge pulses in one field.

As shown in FIG. 6, when the sustain discharge pulse control process is started, display data is input in step ST101, and the process proceeds to step ST102 where the display load ratio (L{SF(n)}) for each subfield SF is determined by the data converter 1; then, in step ST103, the weighted average load ratio (WAL) is determined considering the weight of each subfield SF (for example, SF0:SF1:SF2:SF3:SF4:SF5=1:2:4:8:16:32 in the example of FIG. 3), and in step ST104, the number of sustain discharge pulses (S: Number of SUSs) in one field (frame) is determined (calculated).

Next, the process proceeds to step ST105 where the subfield SF count value n is set to 0, and in step ST106, the calculated number, S, of sustain discharge pulses is compared with the number, A, of sustain discharge pulses whose pulse width can be made wider identically in all the subfields SF.

If it is determined in step ST106 that the relation S≦A holds, the process proceeds to step ST113 where the count value n is compared with the number of subfields SF. If it is determined in step ST113 that the relation n≧N does not hold, that is, the count value n has not yet reached the largest weight subfield SFn, then in step ST114 the count value, m, of the number of sustain discharge pulses in each subfield SF is set to 0, and in step ST115, m is compared with M{SF(n)}. Here, M{SF(*)} indicates the number of pulses in the subfield SF(*) that have an off time that can make the pulse width of every sustain discharge pulse wider.

If it is determined in step ST115 that the relation m≧M{SF(n)} does not hold, the process proceeds to step ST116 where P{SF(n), m} is set to P3 (wide sustain discharge pulse width), and then in step ST117, m is incremented by 1, after which the process returns to step ST115. Here, P{SF(*), m} indicates the output pulse width of the sustain discharge pulse in the subfield SF(*).

If it is determined in step ST115 that the relation m≧M{SF(n)} holds, the process proceeds to step ST118 where the count value n is incremented by 1, after which the process returns to step ST113 to repeat the same process as described above. Then, if it is determined in step ST113 that the relation n≧N holds, that is, the count value n has reached the largest weight subfield SFn, the process is terminated.

In this way, when the calculated number, S, of sustain discharge pulses is smaller than the number, A, of sustain discharge pulses whose pulse width can be made wider identically in all the subfields SF (S≦A in step ST106), and when the number of sustain discharge pulses in each subfield SF is smaller than the number of pulses having an off time that can make the pulse width of every sustain discharge pulse wider (m<N{SF(n)} in step ST115), then the pulse width of every one of the sustain discharge pulses in all the subfields SF is made wider (P{SF(n), m}=P3 in step ST116). If there is not enough off period to make every sustain discharge pulse wider, the sustain discharge pulse width needs to be adjusted in accordance with the total number of sustain discharge pulses in that field (frame).

As a method to adjust the sustain discharge pulse width, a change point at which the sustain discharge pulse width is changed is provided, thus setting a threshold value defining the number of sustain discharge pulse repetitions at which the pulse width is changed. The threshold value must be set according to the total number of sustain discharge pulses in each field (frame), and the change point determined for each subfield SF according to the total number of sustain discharge pulses in that field is maintained in a look-up table (LUT). FIG. 6 illustrates an example in which two change points (T1 and T2) are provided for adjusting the sustain discharge pulse width, and a description will be given by focusing attention on a particular subfield SF.

The process flow will be described below.

If it is determined in step ST106 that the relation S≦A does not hold, the process proceeds to step ST107 where n is compared with the number of subfields SF. If it is determined in step ST107 that the relation n≧N does not hold, that is, the count value n has not yet reached the largest weight subfield SFn, the process proceeds to step ST108 where T1{SF(n)} and T2{SF(n)} are determined from the look-up table (LUT) based on the calculated number, S, of sustain discharge pulses. Here, T1{SF(*)} is a timing parameter defining the timing for changing the pulse width in the subfield SF(*), and determines the number of sustain discharge pulse repetitions reaching which data is changed to P3 (wide sustain discharge pulse width). Likewise, T2{SF (*)} is a timing parameter defining the timing for changing the pulse width in the subfield SF(*), and determines the number of sustain discharge pulse repetitions reaching which data is changed to P2 (intermediate sustain discharge pulse width).

The process proceeds to step ST109 where the count value m is set to 0, and in step ST110, m is compared with T1. If it is determined in step ST110 that m≧T1 does not hold, then P{SF(n), m} is set to P1 (narrow sustain discharge pulse width) in step ST111, and m is incremented by 1 in step ST112, after which the process returns to step ST110.

If it is determined in step ST110 that m≧T1 holds, the process proceeds to step ST119 to carry out the steps ST119 to ST121 corresponding to the steps ST110 to ST112. That is, if it is determined in step ST119 that m≧T2 does not hold, then P{SF(n), m} is set to P2 (intermediate sustain discharge pulse width) in step ST120, and m is incremented by 1 in step ST121, after which the process returns to step ST119.

If it is determined in step ST119 that m≧T2 holds, the process proceeds to step ST122 to carry out the steps ST122 to ST124 corresponding to the steps ST110 to ST112 (steps ST119 to ST121). That is, if it is determined in step ST122 that m≧M{SF(n)} does not hold, then P{SF(n), m} is set to P3 (wide sustain discharge pulse width) in step ST123, and m is incremented by 1 in step ST124, after which the process returns to step ST122.

Then, if it is determined in step ST122 that m≧M{SF(n)} holds, the process proceeds to step ST125 where n is incremented by 1, after which the process returns to step ST107 to repeat the same process as described above.

In this way, when there are two pulse width change points, T1{SF(n)} and T2{SF(n)}, in each subfield SF(n) of one field (frame) whose total number of pulses is S, the pulse width in the subfield SF(n) is set to P1 (narrow sustain discharge pulse width) for the first to (T1{SF(n)}−1)th sustain discharge pulses in the sustain discharge period (Tsus), to P2 (intermediate sustain discharge pulse width) for the (T1{SF(n)}+1)th to (T2{SF(n)}−1)th sustain discharge pulses in the sustain discharge period (Tsus), and to P3 (wide sustain discharge pulse width) for all subsequent pulses. That is, the respective sustain discharge pulse widths are defined by the relation P1<P2<P3.

In the above process, the number of change points T1, T2 can be increased as desired; this can be accomplished by setting additional change points (T3, . . . , Tk) and adding a matching number of pulse width determining loops similar to those performed using the change points T1 and T2 in the flowchart of FIG. 6.

Then, if it is determined in step ST107 that the relation n≧N holds, that is, the count value n has reached the largest weight subfield SFn, the process is terminated.

Figure 7:
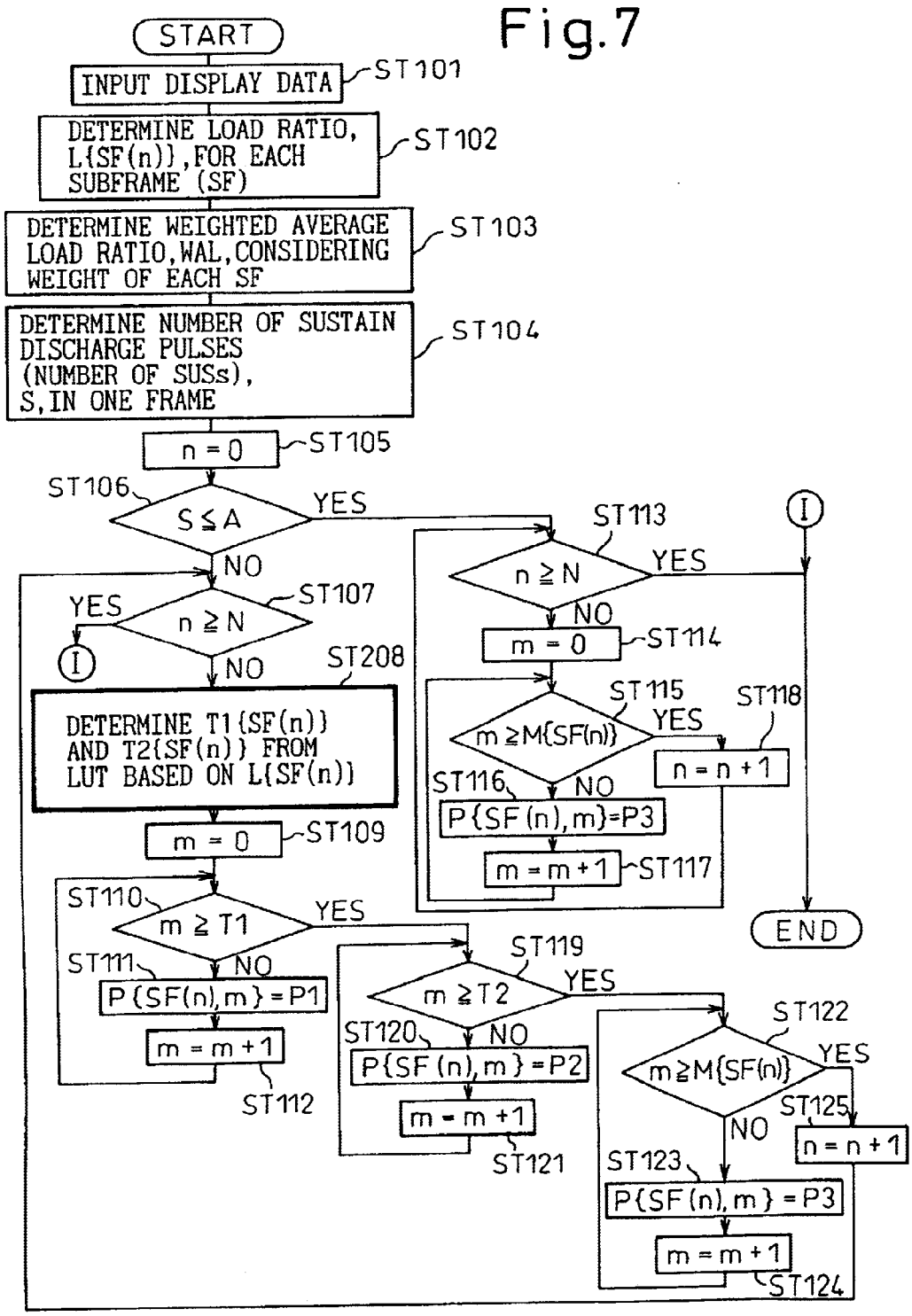
FIG. 7 is a flowchart showing another example of the display apparatus driving method according to the present invention.

FIG. 7 is a flowchart showing another example of the display apparatus driving method according to the present invention, in which the sustain discharge pulse width is controlled in accordance with the load ratio of each of the subfields forming one field.

That is, while, in the driving method shown in FIG. 6, T1{SF(n)} and T2{SF(n)} are determined in step ST108 from the look-up table (LUT) based on the total number, S, of sustain discharge pulses in one field, the driving method of this example shown in FIG. 7 determines T1{SF(n)} and T2{SF(n)} in step ST208 from the look-up table (LUT) based on the load ratio L{SF(n)} of each of the subfields forming one field. Otherwise, the process is the same as that shown in FIG. 6, and will not be further described here.

Figure 8:
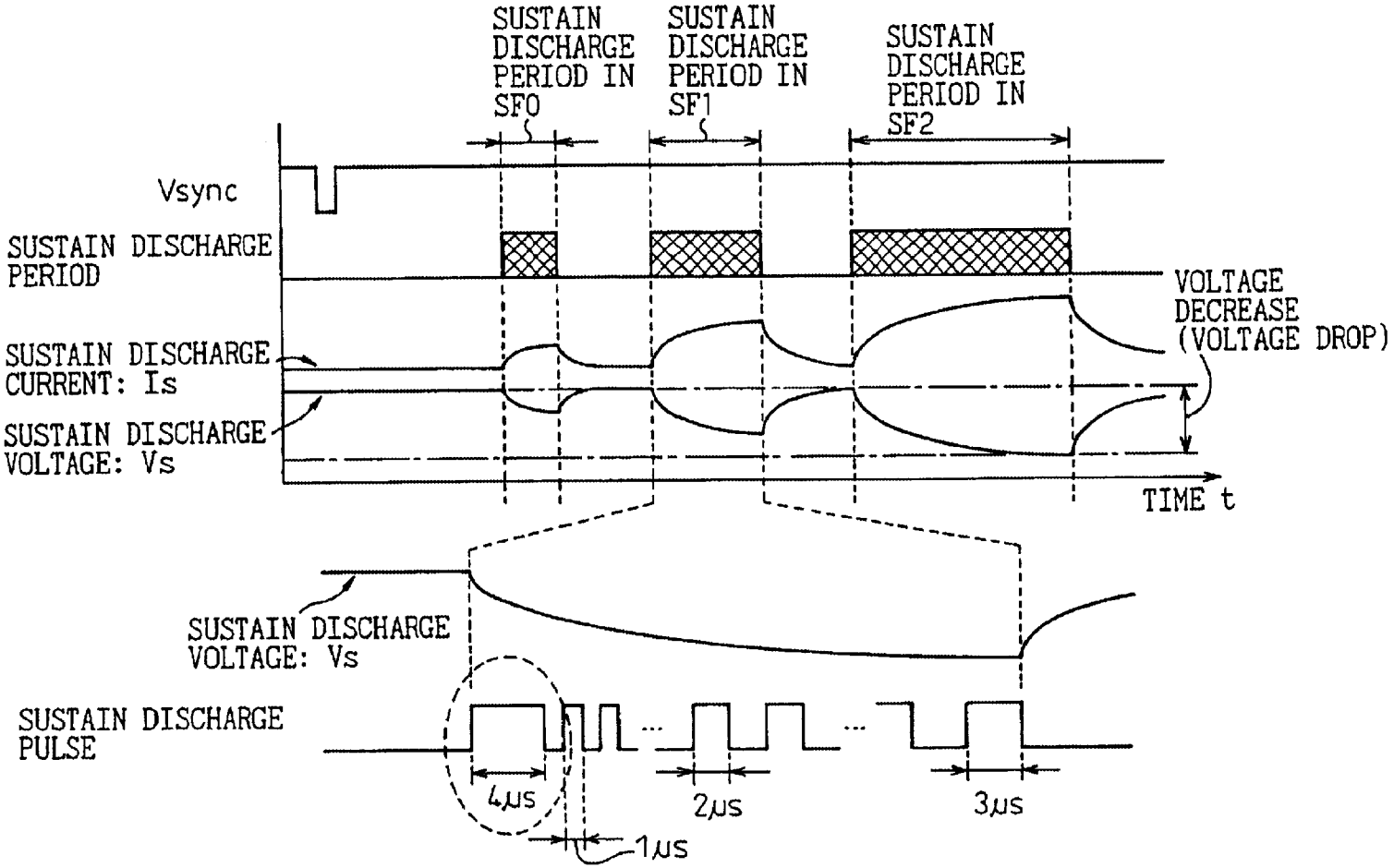
FIG. 8 is a diagram for explaining another embodiment of a display apparatus driving method according to the present invention.

FIG. 8 is a diagram for explaining another embodiment of the display apparatus driving method according to the present invention.

As is apparent from a comparison between FIG. 8 and FIG. 5, the display apparatus driving method of this embodiment performs control in such a manner as to increase the pulse width of the first sustain discharge pulse (for example, to 4 μs) in the sustain discharge period Tsus (Tsus1) in each subfield (for example, subfield SF1), thereby ensuring reliable transition from the address discharge to the sustain discharge. Otherwise, the configuration (sustain discharge pulse width control) is the same as that described with reference to FIG. 5.

In this embodiment, control is performed to increase the pulse width of the first sustain discharge pulse in the sustain discharge period Tsus, but this need not be limited to the first pulse; for example, control may be performed to increase the pulse width of the first two or three sustain discharge pulses.

As described in detail above, according to the present invention, a display apparatus capable of maintaining a high display quality without depending on display ratio can be provided, along with a method for driving such a display apparatus.

Many different embodiments of the present invention may be constructed without departing from the spirit and scope of the present invention, and it should be understood that the present invention is not limited to the specific embodiments described in this specification, except as defined in the appended claims.

What is claimed is:

1. A driving method for a display apparatus that produces light emission by applying a sustain discharge pulse repeatedly, wherein:

a pulse width of said sustain discharge pulse is varied within one subfield and is controlled in accordance with the amount of voltage drop of a sustain discharge voltage.

2. The driving method for a display apparatus as claimed in claim 1, wherein said sustain discharge voltage is actually detected, and the pulse width of said sustain discharge pulse is controlled in accordance with said detected sustain discharge voltage.

3. The driving method for a display apparatus as claimed in claim 1, wherein a load ratio of a plurality of subfields forming one field is detected, and the pulse width of said sustain discharge pulse is controlled in accordance with said detected subfield load ratio.

4. The driving method for a display apparatus as claimed in claim 1, wherein a weighted average load ratio of one entire field is calculated, and the pulse width of said sustain discharge pulse is controlled in accordance with said calculated weighted average load ratio.

5. A driving method for a display apparatus that produces light emission by applying a sustain discharge pulse repeatedly, wherein:

a pulse width of said sustain discharge pulse is varied within one subfield, and control is performed by making the pulse width of said sustain discharge pulse narrow in a first half of a sustain discharge period and wide in a second half thereof.

6. A driving method for a display apparatus that produces light emission by applying a sustain discharge pulse repeatedly, wherein:

a pulse width of said sustain discharge pulse is varied within one subfield, and control is performed so that the pulse width of said sustain discharge pulse is narrow in an early part of a sustain discharge period, but gradually increases toward the end of said sustain discharge period.

7. A driving method for a display apparatus that produces light emission by applying a sustain discharge pulse repeatedly, wherein:

a pulse width of said sustain discharge pulse is varied within one subfield, and control is performed so that the pulse width of said sustain discharge pulse is narrow in a specific part within said subfield, but gradually increases after said specific part within said subfield.

8. The driving method for a display apparatus as claimed in claim 7, wherein the pulse width of said sustain discharge pulse is controlled so that at least a first pulse in said sustain discharge period has a wide pulse width.

9. The driving method for a display apparatus as claimed in claim 7, wherein the total number of sustain discharge pulses in one entire field is calculated, and the pulse width of said sustain discharge pulse is controlled in accordance with said calculated total number of sustain discharge pulses.

10. The driving method for a display apparatus as claimed in claim 9, wherein when said calculated total number of sustain discharge pulses is smaller than the number of sustain discharge pulses whose pulse width is made wider identically in all subfields, and when the number of sustain discharge pulses in each of said subfields is smaller than the number of pulses having an off time that makes the pulse width of every sustain discharge pulse wider, the pulse width of every one of the sustain discharge pulses in said all subfields is made wider.

11. The driving method for a display apparatus as claimed in claim 7, wherein said one field is made up of a plurality of subfields, and a grayscale is displayed by combining said subfields.

12. The driving method for a display apparatus as claimed in claim 7, wherein said display apparatus is a plasma display apparatus.

13. A display apparatus comprising:

a display panel section;

a data converter which receives an image signal and supplies image data suitable for said display apparatus to said display panel section;

a power supply section which supplies power to said display panel section; and a sustain discharge pulse control circuit which varies a pulse width of sustain discharge pulse within one subfield and controls the pulse width of said sustain discharge pulse in accordance with the amount of voltage drop of a sustain discharge voltage.

14. The display apparatus as claimed in claim 13, wherein said power supply section actually detects said sustain discharge voltage, and said sustain discharge pulse control circuit controls the pulse width of said sustain discharge pulse in accordance with said detected sustain discharge voltage.

15. The display apparatus as claimed in claim 13, wherein said data converter detects a load ratio of each of the subfields forming one field, and said sustain discharge pulse control circuit controls the pulse width of said sustain discharge pulse in accordance with said detected load ratio of said each subfield.

16. The display apparatus as claimed in claim 13, wherein said data converter calculates a weighted average load ratio of one entire field, and said sustain discharge pulse control circuit controls the pulse width of said sustain discharge pulse in accordance with said calculated weighted average load ratio.

17. A display apparatus comprising:

a display panel section;

a data converter which receives an image signal and supplies image data suitable for said display apparatus to said display panel section;

a power supply section which supplies power to said display panel section; and a sustain discharge pulse control circuit which varies a pulse width of sustain discharge pulse within one subfield and performs control by making the pulse width of said sustain discharge pulse narrow in a first half of a sustain discharge period and wide in a second half thereof.

18. A display apparatus comprising:

a display panel section;

a data converter which receives an image signal and supplies image data suitable for said display apparatus to said display panel section;

a power supply section which supplies power to said display panel section; and a sustain discharge pulse control circuit which varies a pulse width of sustain discharge pulse within one subfield and performs control so that the pulse width of said sustain discharge pulse is narrow in an early part of a sustain discharge period, but gradually increases toward the end of said sustain discharge period.

19. A display apparatus comprising:

a display panel section;

a data converter which receives an image signal and supplies image data suitable for said display apparatus to said display panel section;

a power supply section which supplies power to said display panel section; and a sustain discharge pulse control circuit which varies a pulse width of sustain discharge pulse within one subfield and performs control so that the pulse width of said sustain discharge pulse is narrow in a specific part within said subfield, but gradually increases after said specific part within said subfield.

20. The display apparatus as claimed in claim 19, wherein said sustain discharge pulse control circuit controls the pulse width of said sustain discharge pulse so that at least a first pulse in said sustain discharge period has a wide pulse width.

21. The display apparatus as claimed in claim 19, further comprising a power control circuit which adjusts the number of sustain discharge pulses by receiving a display load ratio from said data converter and information from said power supply section about power being consumed in said display panel section, and wherein said power control circuit calculates the number of sustain discharge pulses in one entire field, and said sustain discharge pulse control circuit controls the pulse width of said sustain discharge pulse in accordance with said calculated number of sustain discharge pulses.

22. The display apparatus as claimed in claim 21, wherein, when said calculated total number of sustain discharge pulses is smaller than the number of sustain discharge pulses whose pulse width is made identically wider in all subfields, and when the number of sustain discharge pulses in each of said subfields is smaller than the number of pulses having an off time that makes the pulse width of every sustain discharge pulse wider, said sustain discharge pulse control circuit makes the pulse width of every one of the sustain discharge pulses in said all subfields wider.

23. The display apparatus as claimed in claim 19, wherein said one field is made up of a plurality of subfields, and said display apparatus displays a grayscale by combining said subfields.

24. The display apparatus as claimed in claim 19, wherein said display apparatus is a plasma display apparatus.

* * * * *